US009940865B2

(12) United States Patent
Maruyama et al.

(10) Patent No.: US 9,940,865 B2
(45) Date of Patent: Apr. 10, 2018

(54) LIQUID CRYSTAL DISPLAY DEVICE

(71) Applicant: Panasonic Liquid Crystal Display Co., Ltd., Hyogo (JP)

(72) Inventors: Junichi Maruyama, Hyogo (JP); Masahiro Yoshida, Osaka (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 176 days.

(21) Appl. No.: 14/742,705

(22) Filed: Jun. 18, 2015

(65) Prior Publication Data

US 2016/0372022 A1 Dec. 22, 2016

(51) Int. Cl.
*G09G 3/20* (2006.01)
*G09G 3/36* (2006.01)

(52) U.S. Cl.
CPC ..... *G09G 3/2092* (2013.01); *G09G 3/2085* (2013.01); *G09G 3/3607* (2013.01); *G09G 3/3614* (2013.01); *G09G 3/3674* (2013.01); *G09G 3/3685* (2013.01); *G09G 2310/027* (2013.01); *G09G 2310/08* (2013.01); *G09G 2320/02* (2013.01)

(58) Field of Classification Search
CPC .. G09G 3/2092; G09G 3/2085; G09G 3/3607; G09G 3/3614; G09G 3/3674; G09G 3/3685
USPC ..... 345/690
See application file for complete search history.

(56) References Cited

U.S. PATENT DOCUMENTS 8,203,514 B2 * 6/2012 Su ..... G09G 3/2096 345/88
9,223,425 B1 * 12/2015 Kim ..... G06F 3/0412
2001/0015711 A1 * 8/2001 Aoki ..... G09G 3/3611 345/92
2001/0032226 A1 * 10/2001 Takano ..... H03H 17/0294 708/300
2005/0111046 A1 * 5/2005 Kurumisawa ..... G09G 3/20 358/3.06
2007/0139327 A1 * 6/2007 Liu ..... G09G 3/3614 345/89
2009/0303170 A1 * 12/2009 Chung ..... G09G 3/3426 345/102
2010/0214316 A1 * 8/2010 Kim ..... G09G 3/3611 345/618
2010/0277490 A1 * 11/2010 Nam ..... G06F 3/147 345/581

(Continued)

FOREIGN PATENT DOCUMENTS

JP 2005-140883 A 6/2005

*Primary Examiner* — Benyam Ketema
(74) *Attorney, Agent, or Firm* — Hea Law PLLC

(57) ABSTRACT

A liquid crystal display device includes: an image processing circuit configured to carry out image processing on input display data input from an outside; and a timing controller configured to receive display data subjected to the image processing by the image processing circuit, to thereby generate a plurality of timing signals for defining an operation timing of a data line driving circuit and an operation timing of a gate line driving circuit, the image processing circuit being configured to receive at least one timing signal among the plurality of timing signals generated by the timing controller, to thereby carry out the image processing on the input display data based on the received at least one timing signal.

9 Claims, 11 Drawing Sheets

(56) References Cited

U.S. PATENT DOCUMENTS

| | | | | |
|---|---|---|---|---|
| 2010/0277494 | A1* | 11/2010 | Cho | G09G 3/3614 345/589 |
| 2011/0057964 | A1* | 3/2011 | Kanazawa | G09G 3/2081 345/690 |
| 2012/0120058 | A1* | 5/2012 | Lee | G09G 3/003 345/419 |
| 2012/0162178 | A1* | 6/2012 | Oh | G09G 3/3648 345/211 |
| 2013/0300773 | A1* | 11/2013 | Kim | G09G 5/10 345/690 |
| 2014/0092355 | A1* | 4/2014 | Teranuma | G02F 1/13306 349/139 |
| 2016/0188062 | A1* | 6/2016 | Jung | G06F 3/0412 345/173 |

* cited by examiner

LIQUID CRYSTAL DISPLAY DEVICE

BACKGROUND OF THE INVENTION

1. Field of the Invention

This application relates to a liquid crystal display device.

2. Description of the Related Art

A related-art liquid crystal display device includes a display panel, a data line driving circuit configured to supply data signals to data lines formed on the above-mentioned display panel, a gate line driving circuit configured to supply gate signals to gate lines formed on the above-mentioned display panel, and a timing controller configured to control drive of the above-mentioned data line driving circuit and the above-mentioned gate line driving circuit. Further, for example, in order to enhance the display quality, the above-mentioned liquid crystal display device carries out image processing on input display data in the above-mentioned timing controller. The liquid crystal display device having the above-mentioned image processing function is disclosed in, for example, Japanese Patent Application Laid-open No. 2005-140883.

SUMMARY OF THE INVENTION

As disclosed in the above-mentioned publication, the above-mentioned image processing function is required to be incorporated in the above-mentioned timing controller in advance. Therefore, for example, when the above-mentioned timing controller does not have the above-mentioned image processing function in the existing liquid crystal display device, it is necessary to manufacture a new timing controller having the above-mentioned image processing function, and then replace the existing timing controller with the new timing controller. In this case, there arises a problem in that the product cost of the liquid crystal display device is increased.

The present application has been made in view of the above-mentioned problem, and has an object to realize a low-cost liquid crystal display device excellent in display quality by adding the image processing function to the existing liquid crystal display device.

In order to solve the problems described above, according to one embodiment of this application, there is provided a liquid crystal display device, including: a display panel including: a plurality of gate lines extending in a row direction; and a plurality of data lines extending in a column direction; a data line driving circuit configured to supply a plurality of data signals to the plurality of data lines; a gate line driving circuit configured to supply a plurality of gate signals to the plurality of gate lines; an image processing circuit configured to carry out image processing on input display data input from an outside; and a timing controller configured to receive display data subjected to the image processing by the image processing circuit, to thereby generate a plurality of timing signals for defining an operation timing of the data line driving circuit and an operation timing of the gate line driving circuit, the image processing circuit being configured to receive at least one timing signal among the plurality of timing signals generated by the timing controller, to thereby carry out the image processing on the input display data based on the received at least one timing signal.

In the liquid crystal display device according to one embodiment of this application, the image processing circuit and the timing controller may be each configured of an individual integrated circuit (IC).

In the liquid crystal display device according to one embodiment of this application, the at least one timing signal input from the timing controller to the image processing circuit may include a signal for determining a polarity of the plurality of data signals to be supplied to the plurality of data lines.

In the liquid crystal display device according to one embodiment of this application, the at least one timing signal input from the timing controller to the image processing circuit may include a signal for determining whether or not to supply the plurality of gate signals from the gate line driving circuit to the plurality of gate lines.

In the liquid crystal display device according to one embodiment of this application, the image processing circuit may include a plurality of image processing circuits, the timing controller may include a plurality of timing controllers, and each of the plurality of image processing circuits may receive at least one timing signal among the plurality of timing signals generated in the timing controller corresponding to the each of the plurality of image processing circuits, to thereby carry out the image processing on the input display data based on the received at least one timing signal.

In the liquid crystal display device according to one embodiment of this application, the plurality of timing controllers may be cascade-connected to each other, and the at least one timing signal output from the timing controller may be input to the image processing circuit corresponding to the timing controller, and may be also input to the adjacent timing controller.

In the liquid crystal display device according to one embodiment of this application, the plurality of image processing circuits may not directly connected to each other.

In the liquid crystal display device according to one embodiment of this application, the image processing circuit may correct an input grayscale corresponding to the input display data to a grayscale that is one of higher and lower than a target grayscale.

In the liquid crystal display device according to one embodiment of this application, the image processing circuit may correct the input display data so that a correction amount for the input display data corresponding to the plurality of data signals with a positive polarity and a correction amount for the input display data corresponding to the plurality of data signals with a negative polarity are different from each other.

In the liquid crystal display device according to one embodiment of this application, the image processing circuit may correct the input display data so that a correction amount for the input display data corresponding to the plurality of data signals with a positive polarity is larger than a correction amount for the input display data corresponding to the plurality of data signals with a negative polarity.

In the liquid crystal display device according to one embodiment of this application, the image processing circuit may correct an input grayscale of each pixel corresponding to the input display data in accordance with a position of a pixel in a display region.

DETAILED DESCRIPTION OF THE INVENTION

Figure 1:
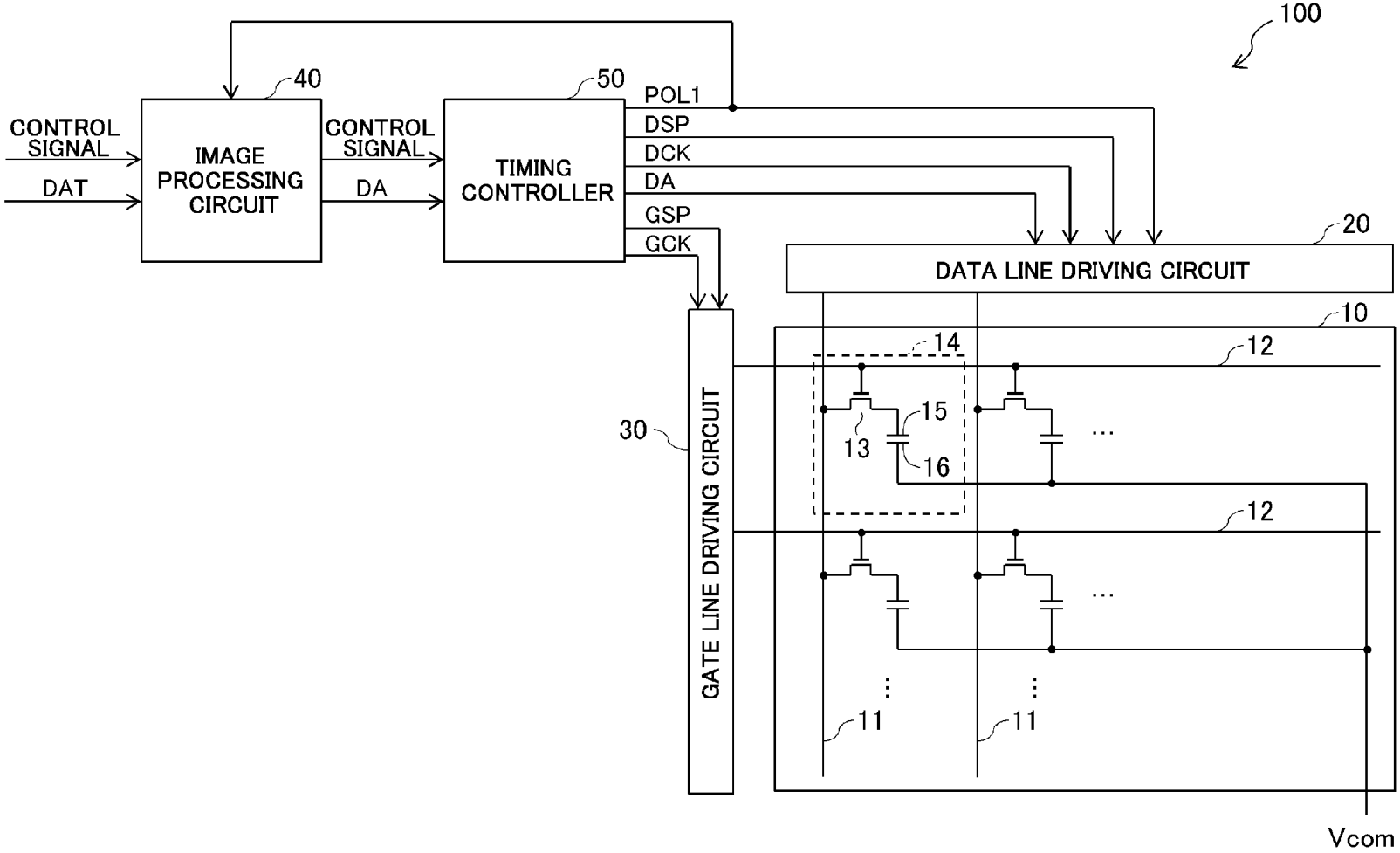
FIG. 1 is a plan view for illustrating a schematic configuration of a liquid crystal display device according to an embodiment of this application.

An embodiment of this application is described below with reference to the drawings. FIG. 1 is a plan view for illustrating a schematic configuration of a liquid crystal display device according to this embodiment. A liquid crystal display device 100 includes a display panel 10, a data line driving circuit 20, a gate line driving circuit 30, an image processing circuit 40, a timing controller 50, and a backlight unit (not shown). The image processing circuit 40 and the timing controller 50 are each configured of an individual integrated circuit (IC).

The display panel 10 includes a plurality of data lines 11 extending in a column direction, and a plurality of gate lines 12 extending in a row direction. A thin film transistor 13 (TFT) is formed at each intersecting portion between each data line 11 and each gate line 12. Each data line 11 is connected to the data line driving circuit 20. Each gate line 12 is connected to the gate line driving circuit 30.

Further, the display panel 10 includes a plurality of pixels 14 arranged in matrix (in the row direction and the column direction) so as to correspond to each intersecting portion between each data line 11 and each gate line 12. Note that, although not shown, the display panel 10 includes a thin film transistor substrate (TFT substrate), a color filter substrate (CF substrate), and a liquid crystal layer sandwiched between both the substrates. The TFT substrate includes a plurality of pixel electrodes 15 arranged so as to correspond to the respective pixels 14. The CF substrate includes a common electrode 16 common to the respective pixels 14. Note that, the common electrode 16 may be formed on the TFT substrate.

Each data line 11 is supplied with a data signal (data voltage) from the data line driving circuit 20. Each gate line 12 is supplied with a gate signal (gate voltage) from the gate line driving circuit 30. The common electrode 16 is supplied with a common voltage Vcom from a common electrode driving circuit (not shown). When an on voltage of the gate signal is supplied to the gate line 12, the thin film transistor 13 connected to the gate line 12 is turned on so that the data voltage is supplied to the pixel electrode 15 via the data line 11 connected to the thin film transistor 13. An electric field is generated by the difference between the data voltage supplied to the pixel electrode 15 and the common voltage Vcom supplied to the common electrode 16. This electric field is used to drive the liquid crystal and control the transmittance of the light from the backlight unit. In this manner, an image is displayed. Note that, in the case of color display, the color display is realized by supplying desired data voltages to the data lines 11 connected to the respective pixel electrodes 15 of the pixels 14 corresponding to respective red color, green color, and blue color formed of vertical stripe-shaped color filters. Further, in order to prevent screen burn-in of a display image or the like, a positive-polarity data voltage and a negative-polarity data voltage are alternately supplied to each data line 11.

The timing controller 50 generates display data DA for image display and a plurality of timing signals for defining operation timings of the data line driving circuit 20 and the gate line driving circuit 30. Specifically, the timing controller 50 generates a plurality of timing signals including a polarity control signal POL1, a data start pulse DSP, a data clock DCK, a gate start pulse GSP, and a gate clock GCK based on a control signal (clock signal, vertical synchronizing signal, and horizontal synchronizing signal) supplied from the image processing circuit 40. The timing controller 50 supplies the plurality of generated timing signals to the data line driving circuit 20 and the gate line driving circuit 30, to thereby control drive of the data line driving circuit 20 and the gate line driving circuit 30. Specifically, the timing controller 50 supplies the polarity control signal POL1, the data start pulse DSP, the data clock DCK, and the display data DA to the data line driving circuit 20. Further, the timing controller 50 supplies the gate start pulse GSP and the gate clock GCK to the gate line driving circuit 30. A well-known configuration is applicable to the timing controller 50.

The polarity control signal POL1 is a control signal for determining the polarity of the data voltage to be supplied to the data line 11. The polarity control signal POL1 is a signal that switches between a high level and a low level for each frame (or a plurality of frames) or for each line (or a plurality of lines). For example, when the polarity control signal POL1 is at a low level, the data line driving circuit 20 supplies, to the data line 11, a voltage higher than the common voltage Vcom (positive-polarity voltage) based on the display data DA. On the other hand, when the polarity control signal POL1 is at a high level, the data line driving circuit 20 supplies, to the data line 11, a voltage lower than the common voltage Vcom (negative-polarity voltage) based on the display data DA. As described above, the data line driving circuit 20 switches the polarity of the voltage in accordance with the display data DA at a predetermined period and supplies the voltage to the data line 11.

The image processing circuit 40 inputs a video signal (input display data DAT) and a control signal (clock signal, vertical synchronizing signal, and horizontal synchronizing signal), which are output from an external display system (signal source) such as a personal computer, and inputs (is fed back with) the polarity control signal POL1, which is output from the timing controller 50 to the data line driving circuit 20. The image processing circuit 40 carries out image processing on the input display data DAT based on the input display data DAT, the control signal, and the polarity control signal POL1, to thereby generate the display data DA. The image processing circuit 40 supplies the generated display data DA to the timing controller 50. The image processing circuit 40 carries out, for example, image processing for enhancing the display quality or image processing for reducing the power consumption. The image processing circuit 40 is configured of, for example, a field programmable gate array (FPGA).

Figure 2:
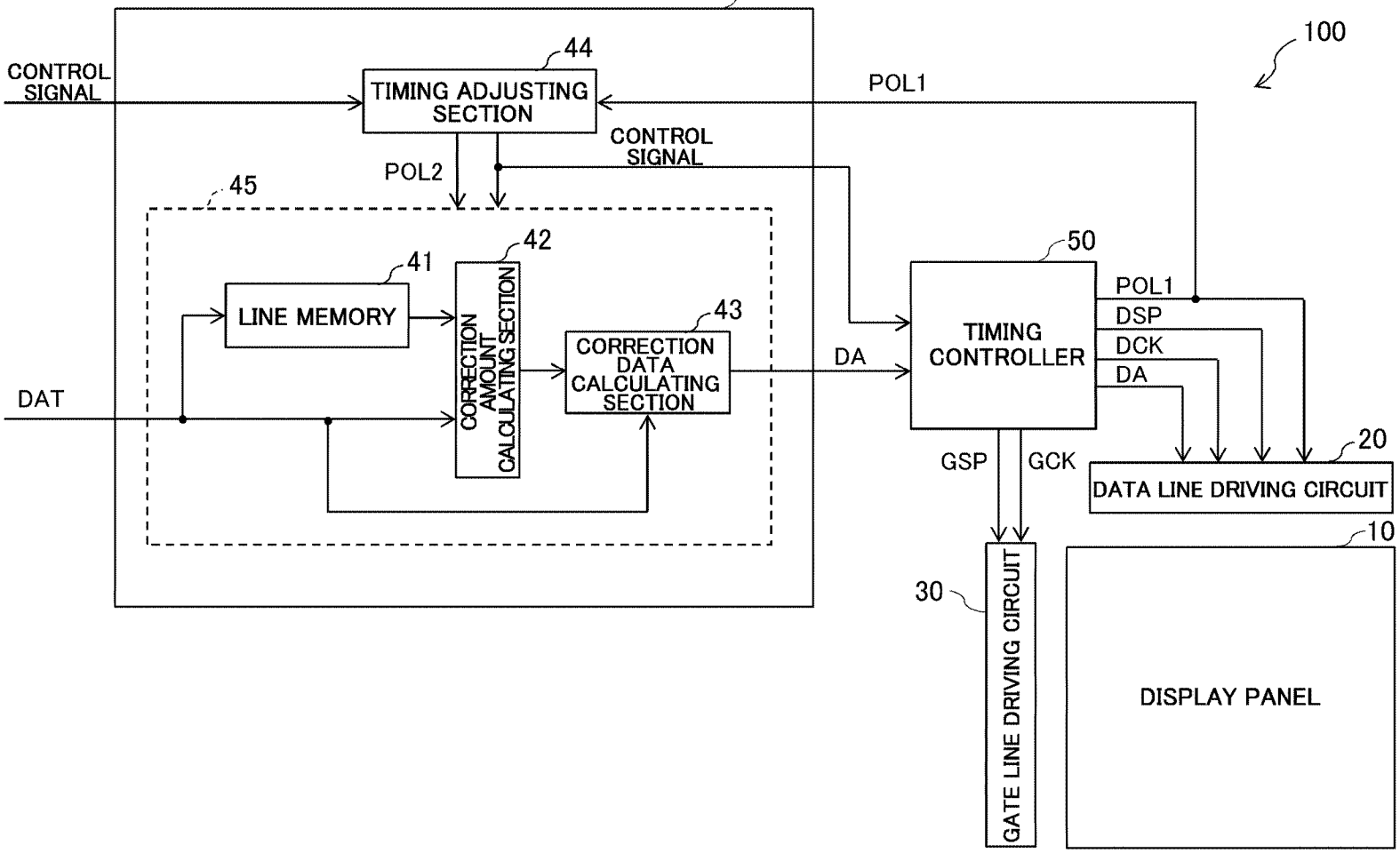
FIG. 2 is a functional block diagram for illustrating a configuration example of an image processing circuit.

FIG. 2 is a functional block diagram for illustrating a configuration example of the image processing circuit 40. The image processing circuit 40 includes a timing adjusting section 44 and a grayscale enhancement processing section 45.

Figure 3:
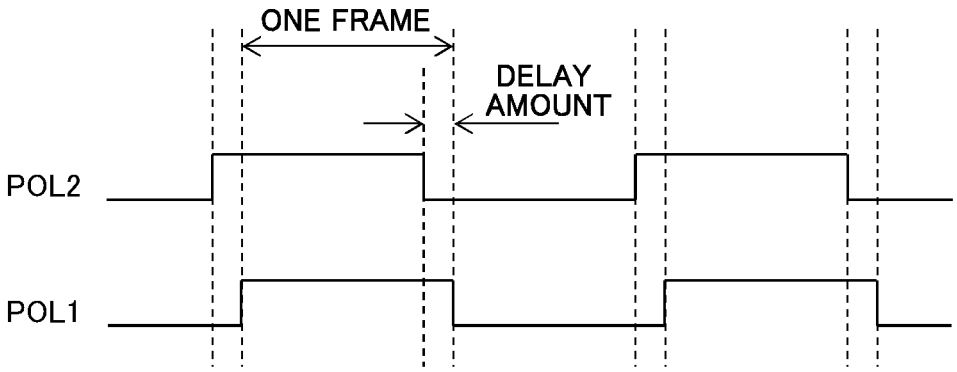
FIG. 3 is a timing chart for comparing a waveform of a polarity control signal POL1 and a waveform of a polarity control signal POL2 with each other.

The timing adjusting section 44 transfers the control signal supplied from the external display system to the grayscale enhancement processing section 45 and the timing controller 50. Further, the timing adjusting section 44 adjusts the phase of the polarity control signal POL1 supplied from the timing controller 50, and supplies an adjusted polarity control signal POL2 to the grayscale enhancement processing section 45. The timing adjusting section 44 can be configured of, for example, a delay circuit. FIG. 3 is a timing chart for comparing the waveform of the polarity control signal POL1 output from the timing controller 50 and the waveform of the polarity control signal POL2 adjusted by the timing adjusting section 44 with each other. As illustrated in FIG. 3, the timing adjusting section 44 adjusts the phase so that the inversion timing between the high level and the low level in the polarity control signal POL2 is prior to the inversion timing between the high level and the low level in the polarity control signal POL1. For example, the timing adjusting section 44 adjusts the phase by predicting a delay amount of the operation timing of the timing controller 50 with respect to the operation timing of the image processing circuit 40, which is required for operating the image processing circuit 40 and the timing controller 50 in synchronization with each other. With this, the image processing circuit 40 and the timing controller 50 can be operated in synchronization with each other. The synchronous operation between the image processing circuit 40 and the timing controller 50 enables prevention of display problems such as screen burn-in.

Figure 4:
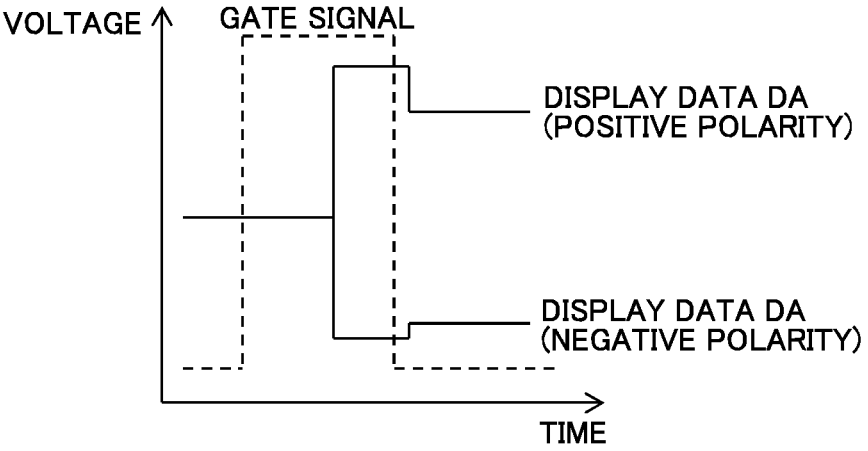
FIG. 4 is a waveform chart for illustrating waveforms of a positive-polarity display data and a negative-polarity display data.

The grayscale enhancement processing section 45 includes a line memory 41, a correction amount calculating section 42, and a correction data calculating section 43. The grayscale enhancement processing section 45 carries out image processing of enhancing and correcting the input grayscale corresponding to the input display data DAT based on the control signal and the polarity control signal POL2, which are supplied from the timing adjusting section 44. Further, the grayscale enhancement processing section 45 corrects the input display data DAT so that a correction amount for the input display data DAT corresponding to the positive-polarity display data DA and a correction amount for the input display data DAT corresponding to the negative-polarity display data DA are different from each other. For example, as illustrated in FIG. 4, the grayscale enhancement processing section 45 corrects the input display data DAT so that the correction amount for the input display data DAT corresponding to the positive-polarity display data DA is larger than the correction amount for the input display data DAT corresponding to the negative-polarity display data DA. Note that, the grayscale enhancement processing section 45 may correct the input display data DAT so that the correction amount for the input display data DAT corresponding to the positive-polarity display data DA is smaller than the correction amount for the input display data DAT corresponding to the negative-polarity display data DA. A specific method of the above-mentioned image processing is described below.

The line memory 41 stores the input display data DAT corresponding to pixels for one line. The line memory 41 can be configured of a memory such as a first-in first-out (FIFO) or a random access memory (RAM). The line memory 41 may store the input display data DAT corresponding to pixels for a plurality of lines, or may store the input display data DAT corresponding to pixels for one frame or for a plurality of frames. For example, when input display data DAT(n) of the n-th line (current line) is input to the image processing circuit 40, input display data DAT(n−1) of the previous line ((n−1)th line) stored in the line memory 41 is read out from the line memory 41, and the input display data DAT(n) of the current line is stored in the line memory 41. The symbol "n" herein refers to the number of the line to be scanned.

The correction amount calculating section 42 calculates the correction amount for enhancing and correcting the grayscale (input grayscale) corresponding to the input display data DAT(n) of the current line based on the input display data DAT(n) of the current line input to the image processing circuit 40, the input display data DAT(n−1) of the previous line read out from the line memory 41, and the polarity control signal POL2. For example, the correction amount calculating section 42 calculates the above-mentioned correction amount with reference to a look-up table for a positive polarity when the polarity control signal POL2 is at the low level, and calculates the above-mentioned correction amount with reference to a look-up table for a negative polarity when the polarity control signal POL2 is at the high level. In each of the look-up table for the positive polarity and the look-up table for the negative polarity, the correction amount is stored, which is set in advance so as to correspond to a combination between the input grayscale of the input display data DAT(n) of the current line and the input grayscale of the input display data DAT(n−1) of the previous line. The above-mentioned correction amount is set to such a value that the change amount from the input grayscale of the previous line to the input grayscale of the current line increases. Further, it is preferred that the correction amount of each look-up table be set so that the grayscale change of the positive-polarity display data DA is larger than the grayscale change of the negative-polarity display data DA. The correction amount calculating section 42 may calculate the above-mentioned correction amount through computing. Note that, the input grayscale of the input display data DAT(n) is a grayscale as a target that is originally required to be displayed (target grayscale).

The correction data calculating section 43 corrects the input grayscale of the input display data DAT(n) of the current line input to the image processing circuit 40 based on the correction amount calculated by the correction amount calculating section 42. The input display data DAT(n) whose input grayscale has been corrected is output to the data line driving circuit 20 as the display data DA(n). For example, the correction data calculating section 43 adds the correction amount calculated in accordance with the polarity to the input grayscale corresponding to the input display data DAT(n). The grayscale obtained through adding is referred to as "corrected grayscale". The display data DA(n) corresponding to the corrected grayscale is output to the data line driving circuit 20. The correction data calculating section 43 can be configured of an adder.

Note that, each of the look-up table for the positive polarity and the look-up table for the negative polarity may store the corrected grayscale set in advance so as to correspond to a combination between the input grayscale of the input display data DAT(n) of the current line and the input grayscale of the input display data DAT(n−1) of the previous line. In this case, the image processing circuit 40 may omit the correction amount calculating section 42.

With the above-mentioned configuration, the input display data DAT(n) input to the image processing circuit 40 has its input grayscale corrected in accordance with the polarity of the voltage to be supplied to the data line 11, and is then output to the data line driving circuit 20 as the display data DA(n).

Figure 5:
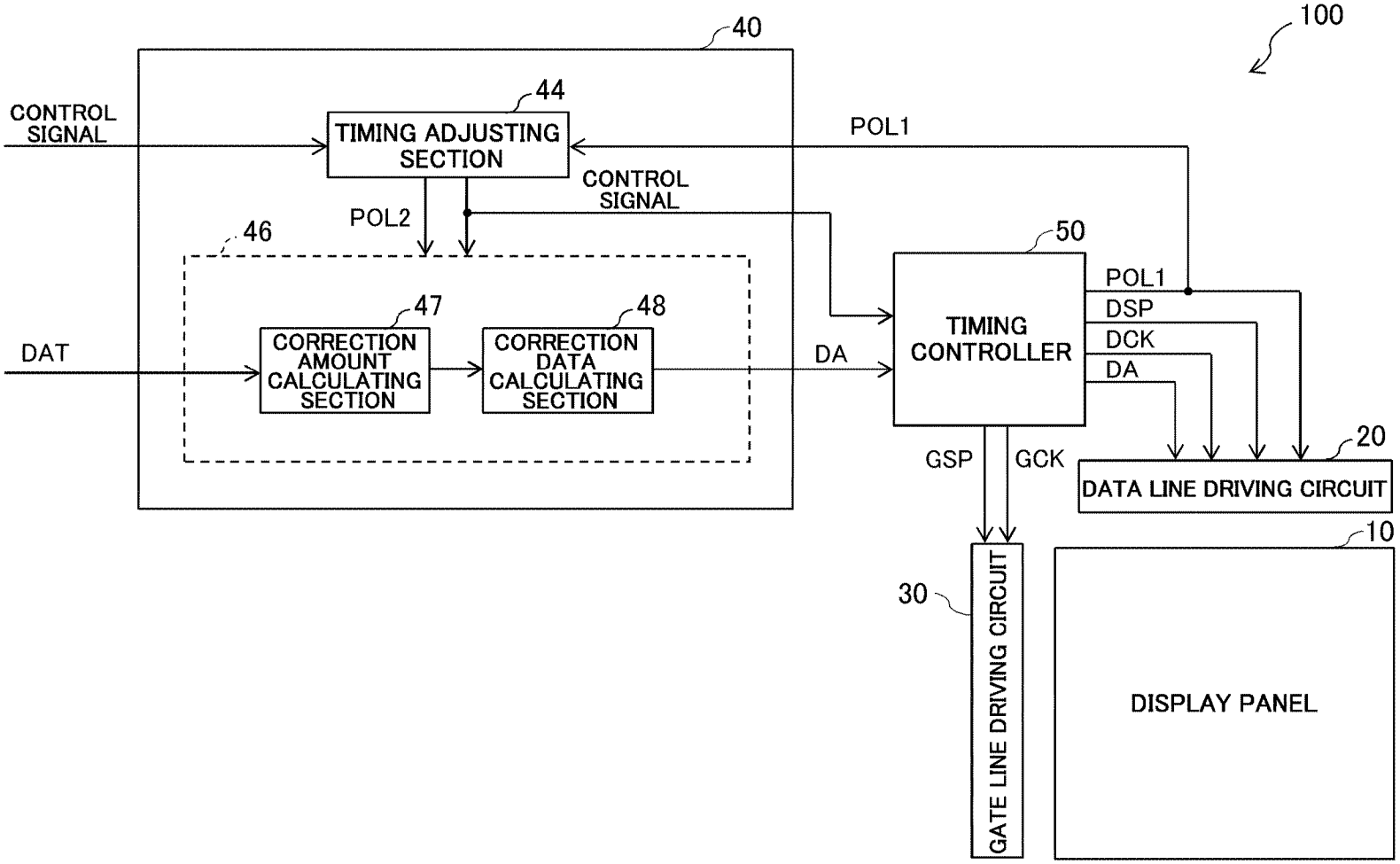
FIG. 5 is a functional block diagram for illustrating another configuration example of the image processing circuit.

The image processing carried out by the image processing circuit 40 is not limited to the image processing of enhancing and correcting the grayscale of the input display data described above, and other image processing may be employed. FIG. 5 is a functional block diagram for illustrating another configuration example of the image processing circuit 40. The image processing circuit 40 illustrated in FIG. 5 carries out image processing for suppressing display unevenness (for example, vertical streaks) caused by fluctuations in distribution in the display region of the common voltage Vcom supplied to the common electrode 16.

The image processing circuit 40 illustrated in FIG. 5 includes the timing adjusting section 44 and a grayscale correction processing section 46. The timing adjusting section 44 has the same function as the timing adjusting section 44 of FIG. 2. The grayscale correction processing section 46 includes a correction amount calculating section 47 and a correction data calculating section 48.

Figure 6:
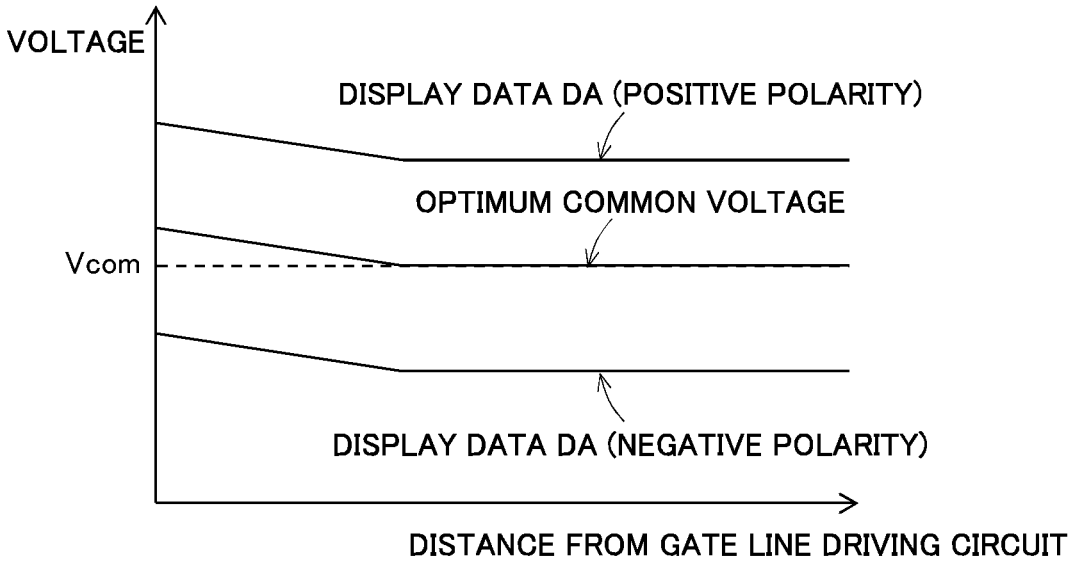
FIG. 6 is a waveform chart for illustrating waveforms of the positive-polarity display data and the negative-polarity display data.

The grayscale correction processing section 46 carries out image processing of correcting the input grayscale corresponding to the input display data DAT to a grayscale higher or lower than the target grayscale based on the control signal and the polarity control signal POL2, which are supplied from the timing adjusting section 44. For example, as illustrated in FIG. 6, the grayscale correction processing section 46 carries out correction of adding the correction amount to the input grayscale for the input display data DAT corresponding to the positive-polarity display data DA, and carries out correction of subtracting the correction amount from the input grayscale for the input display data DAT corresponding to the negative-polarity display data DA. The grayscale correction processing section 46 may carry out correction of subtracting the correction amount from the input grayscale for the input display data DAT corresponding to the positive-polarity display data DA, and may carry out correction of adding the correction amount to the input grayscale for the input display data DAT corresponding to the negative-polarity display data DA. A specific method of the above-mentioned image processing is described below.

The correction amount calculating section 47 calculates the correction amount in accordance with the distance from the center of the display region in the display region. For example, the correction amount calculating section 47 calculates the correction amount so that the correction amount increases toward the right or left end portion of the display region from the center of the display region. The correction amount calculating section 47 refers to a look-up table in which the distance from the center of the display region and the correction amount in accordance with the above-mentioned distance are registered in an associated manner in advance, and calculates the correction amount corresponding to the input display data DAT.

The correction data calculating section 48 corrects the input grayscale of the input display data DAT input to the image processing circuit 40 based on the correction amount calculated by the correction amount calculating section 47 and the polarity control signal POL2 supplied from the timing adjusting section 44. In general, due to the field-through phenomenon, the optimum common voltage Vcom in a region close to the gate line driving circuit 30 in the display region is higher than the optimum common voltage Vcom in a region far from the gate line driving circuit 30 in the display region. Therefore, for example, for the pixels in the region close to the gate line driving circuit 30 (for example, left end portion side), the correction data calculating section 48 adds the above-mentioned correction amount to the input grayscale of the input display data DAT so that the grayscale of the positive-polarity display data DA is increased when the polarity control signal POL2 is at the low level, and subtracts the above-mentioned correction amount from the input grayscale of the input display data DAT so that the grayscale of the negative-polarity display data DA is decreased when the polarity control signal POL2 is at the high level. Note that, for the pixels in the region far from the gate line driving circuit 30 in the display region, the above-mentioned image processing may not be carried out. The correction data calculating section 48 supplies the display data DA corresponding to the grayscale obtained through correction (corrected grayscale) to the data line driving circuit 20.

With the above-mentioned configuration, the input display data DAT input to the image processing circuit 40 has its input grayscale corrected in accordance with the polarity of the voltage to be supplied to the data line 11, and is then output to the data line driving circuit 20 as the display data DA. With this, the above-mentioned display unevenness can be suppressed.

As described above, the image processing circuit 40 illustrated in FIG. 2 and FIG. 5 carries out the image processing of correcting the grayscale of the input display data DAT based on the polarity information of the polarity control signal POL1 output from the timing controller 50 to the data line driving circuit 20. Further, the timing controller 50 does not have the image processing function illustrated in FIG. 2 or FIG. 5. Therefore, the image processing circuit 40 may be externally added to the existing timing controller 50 not having the above-mentioned image processing function, to thereby realize the above-mentioned image processing function. Therefore, by adding the image processing circuit 40 to the existing timing controller 50, for example, a video having a resolution of 8K4K can be displayed at high quality. Further, it is unnecessary to manufacture a new timing controller for realizing the above-mentioned image processing function, for example, an 8K4K-compatible timing controller, or replace the existing timing controller with the new timing controller. Therefore, the product cost can be suppressed.

Figure 7:
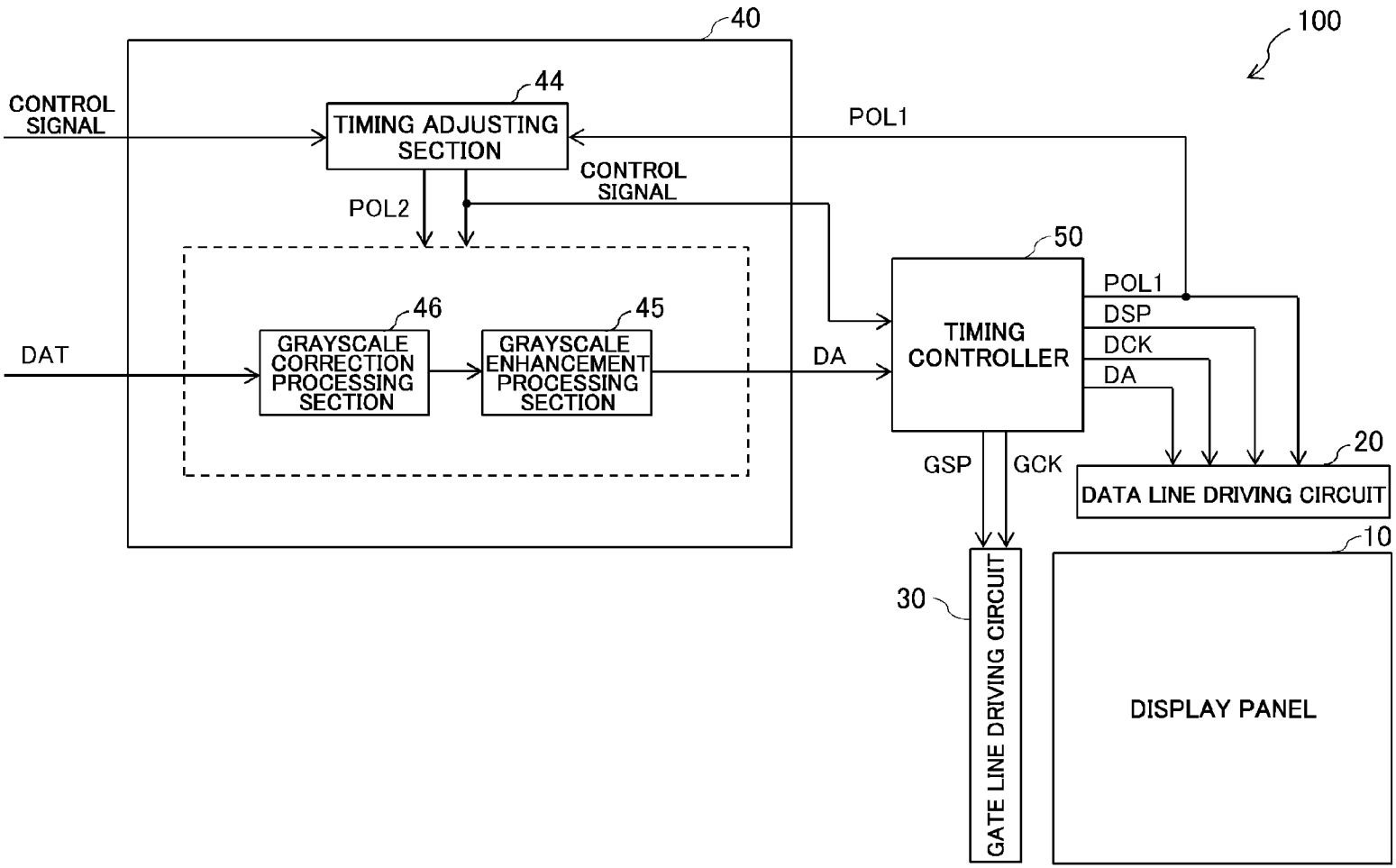
FIG. 7 is a functional block diagram for illustrating another configuration example of the image processing circuit.

Note that, the liquid crystal display device 100 according to this embodiment may include a configuration for realizing the image processing illustrated in FIG. 2 and a configuration for realizing the image processing illustrated in FIG. 5. FIG. 7 is a functional block diagram for illustrating a configuration example of the liquid crystal display device 100 including both of the above-mentioned configurations.

Figure 8:
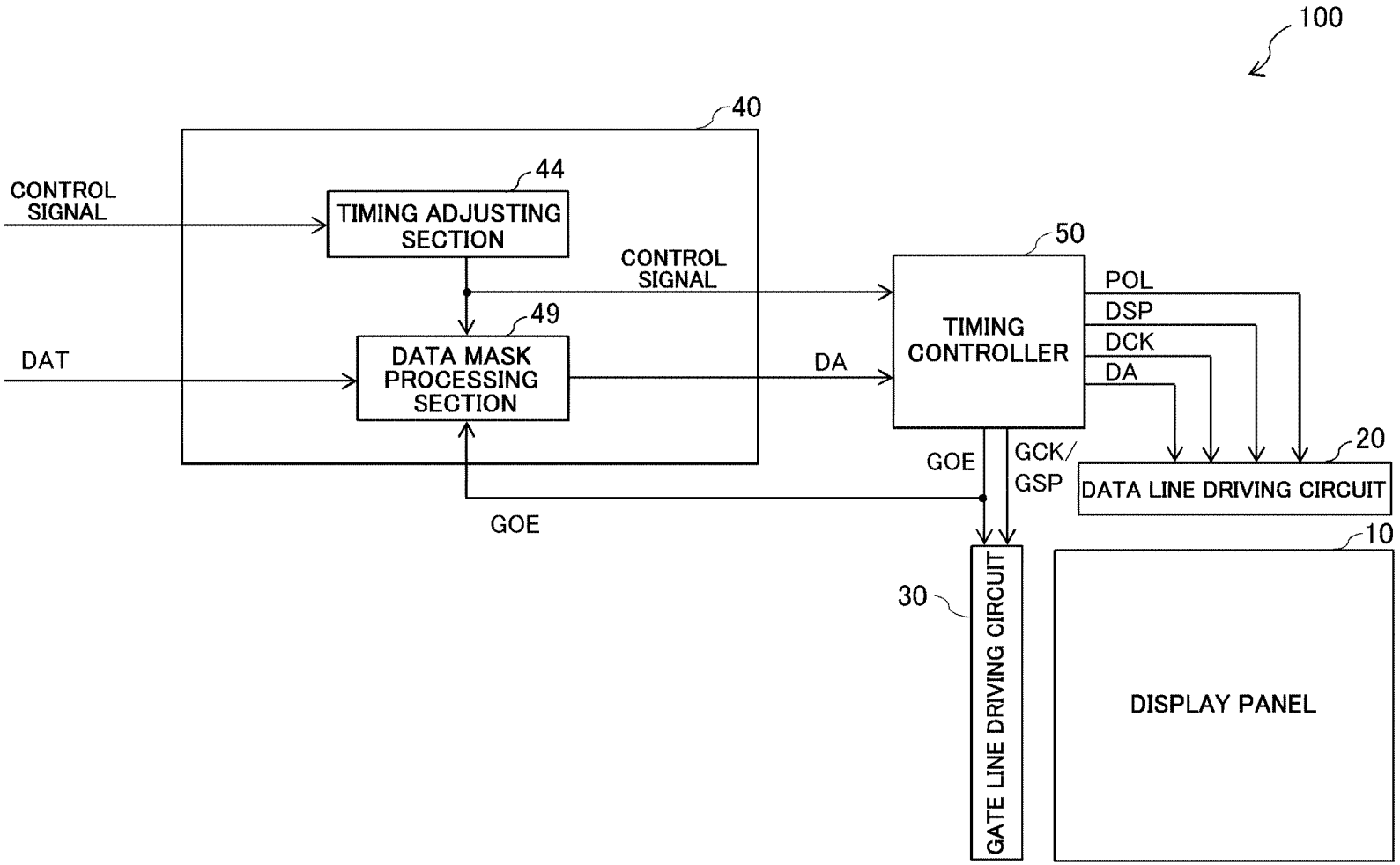
FIG. 8 is a functional block diagram for illustrating another configuration example of the image processing circuit.

FIG. 8 is a functional block diagram for illustrating another configuration example of the image processing circuit 40. The image processing circuit 40 illustrated in FIG. 8 carries out image processing of selecting every several gate lines 12, to thereby realize so-called "interlaced scanning". In the liquid crystal display device 100 illustrated in FIG. 8, the timing controller 50 generates a gate output enable signal GOE based on the control signal (clock signal, vertical synchronizing signal, and horizontal synchronizing signal) supplied from the image processing circuit 40. Note that, the gate output enable signal GOE is a signal for determining whether or not to supply the gate signals from the gate line driving circuit 30 to the plurality of gate lines 12. The timing controller 50 supplies the generated gate output enable signal GOE to the gate line driving circuit 30. The gate line driving circuit 30 stops the output of the gate signals based on the gate output enable signal GOE supplied from the timing controller 50. Further, the image processing circuit 40 receives the gate output enable signal GOE output from the timing controller 50 to the gate line driving circuit 30, and stops (masks) the output of the display data DA based on the received gate output enable signal GOE.

Figure 9:
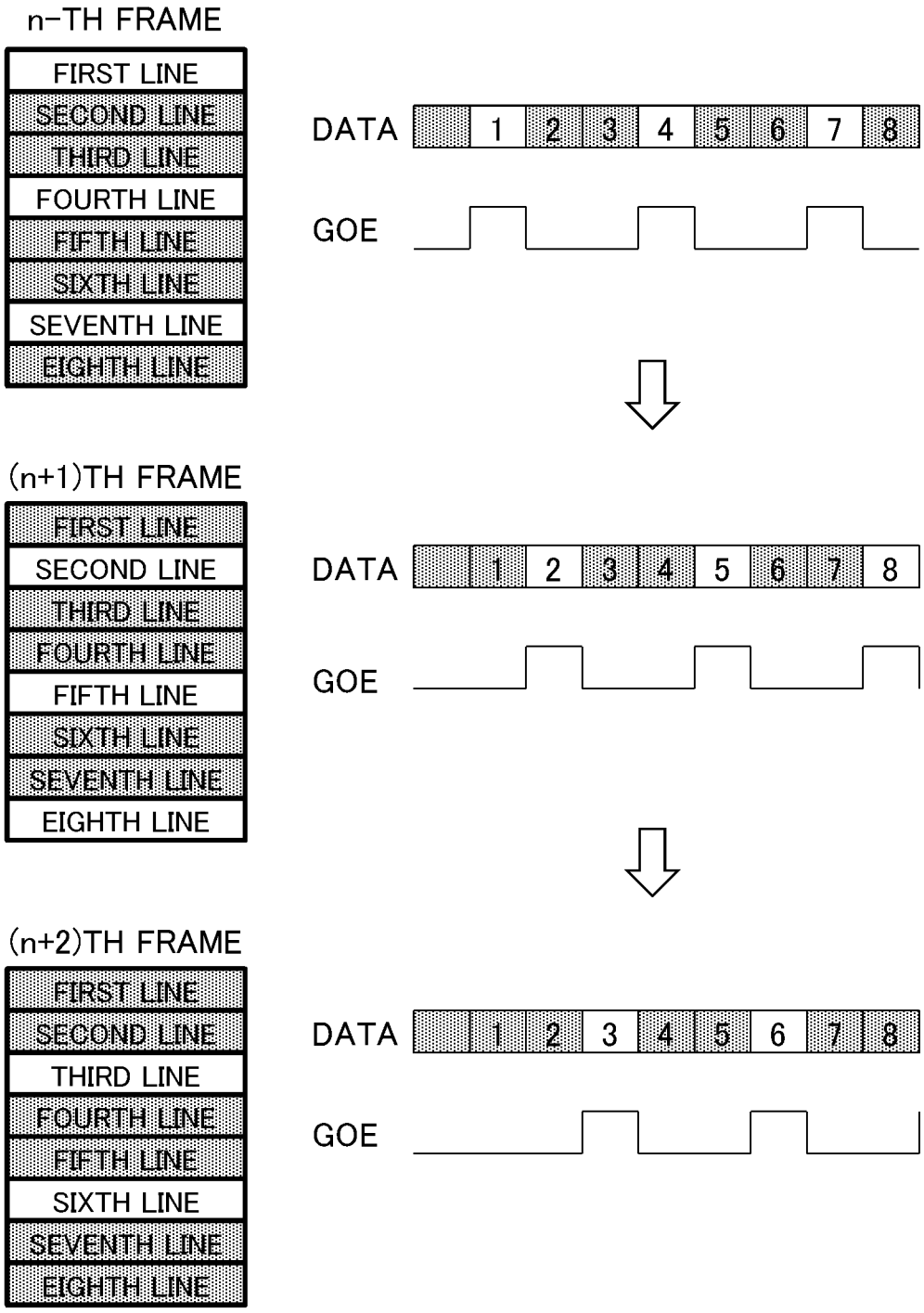
FIG. 9 is a schematic diagram for illustrating an example of interlaced scanning.

FIG. 9 is a schematic view for illustrating an example of the interlaced scanning. In this case, the output of the display data DA is stopped (masked) when the gate output enable signal GOE is at the low level, and the display data DA is output when the gate output enable signal GOE is at the high level. As illustrated in FIG. 9, in the n-th frame, the second line, the third line, the fifth line, the sixth line, and the eighth line are masked, and the display data of the first line, the fourth line, and the seventh line is output. In the (n+1)th frame, the first line, the third line, the fourth line, the sixth line, and the seventh line are masked, and the display data of the second line, the fifth line, and the eighth line is output. In the (n+2)th frame, the first line, the second line, the fourth line, the fifth line, the seventh line, and the eighth line are masked, and the display data of the third line and the sixth line is output.

The configuration of the image processing circuit 40 illustrated in FIG. 8 is described. The image processing circuit 40 inputs the input display data DAT and the control signal, which are output from the external display system, and inputs (is fed back with) the gate output enable signal GOE, which is output from the timing controller 50 to the gate line driving circuit 30. The image processing circuit 40 carries out the image processing on the input display data DAT based on the input display data DAT, the control signal, and the gate output enable signal GOE, to thereby generate the display data DA. The image processing circuit 40 supplies the generated display data DA to the timing controller 50.

Specifically, the image processing circuit 40 includes the timing adjusting section 44 and a data mask processing section 49. The timing adjusting section 44 transfers the control signal supplied from the external display system to the data mask processing section 49 and the timing controller 50.

The data mask processing section 49 masks the output of the display data DA of a predetermined line in the input display data DAT based on the gate output enable signal GOE. In the example of FIG. 9, when the data mask processing section 49 receives the gate output enable signal GOE corresponding to the n-th frame, the data mask processing section 49 determines the line to be masked next, and masks the determined line. Specifically, when the data mask processing section 49 receives the gate output enable signal GOE corresponding to the n-th frame, the data mask processing section 49 masks the first line, the third line, the fourth line, the sixth line, and the seventh line in the input display data DAT of the (n+1)th frame. Further, when the data mask processing section 49 receives the gate output enable signal GOE corresponding to the (n+1)th frame, the data mask processing section 49 masks the first line, the second line, the fourth line, the fifth line, the seventh line, and the eighth line in the input display data DAT of the (n+2)th frame. As described above, the data mask processing section 49 carries out mask processing on the input display data DAT based on the gate output enable signal GOE. The data mask processing section 49 supplies the input display data DAT subjected to the mask processing to the timing controller 50 as the display data DA.

With the above-mentioned configuration, the input display data DAT(n) input to the image processing circuit 40 is subjected to mask processing in accordance with the gate output enable signal GOE, and is then output to the data line driving circuit 20 as the display data DA(n).

As described above, the image processing circuit 40 illustrated in FIG. 8 carries out the image processing of masking the input display data DAT based on the gate output enable signal GOE output from the timing controller 50 to the gate line driving circuit 30. Further, the timing controller 50 does not have the image processing (mask processing) function illustrated in FIG. 8. Therefore, by externally adding the image processing circuit 40 to the existing timing controller 50 not having the above-mentioned image processing function, the above-mentioned image processing function can be realized. Therefore, by adding the image processing circuit 40 to the existing timing controller 50, the power consumption can be reduced. Further, it is unnecessary to manufacture a new timing controller for realizing the above-mentioned image processing function, or replace the existing timing controller with the new timing controller. Therefore, the product cost can be suppressed.

Figure 10:
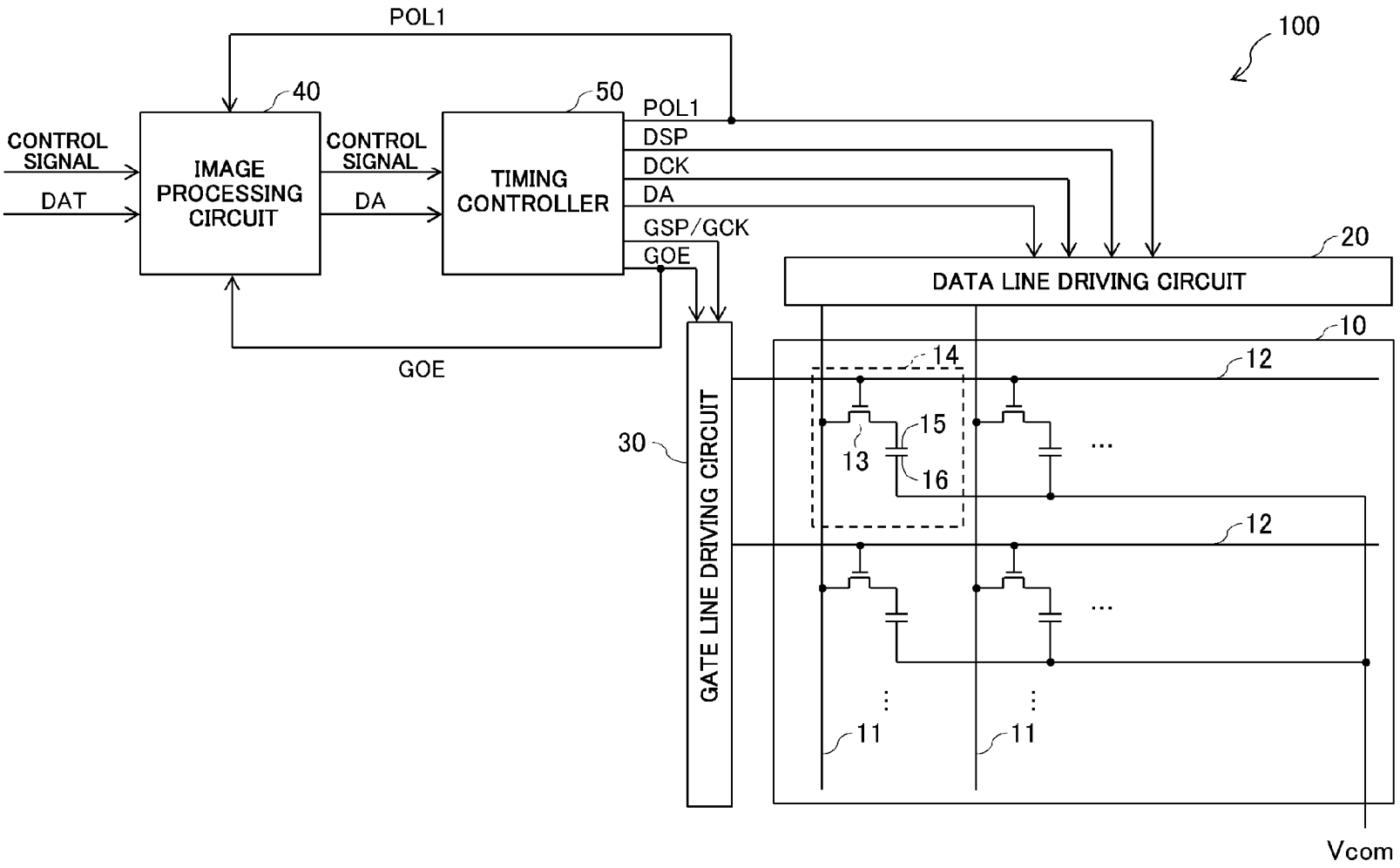
FIG. 10 is a functional block diagram for illustrating another configuration example of the liquid crystal display device.

Note that, the liquid crystal display device 100 according to this embodiment may include the configuration for realizing the image processing illustrated in FIG. 2 and the configuration for realizing the image processing illustrated in FIG. 8, may include the configuration for realizing the image processing illustrated in FIG. 5 and the configuration for realizing the image processing illustrated in FIG. 8, or may include the configuration for realizing the image processing illustrated in FIG. 7 and the configuration for realizing the image processing illustrated in FIG. 8. In the configurations with those combinations, as illustrated in FIG. 10, the polarity control signal POL1 and the gate output enable signal GOE, which are generated by the timing controller 50, are input (fed back) to the image processing circuit 40. That is, the image processing circuit 40 according to this embodiment receives at least one of the plurality of timing signals generated in the timing controller 50 (in this case, the polarity control signal POL1 and the gate output enable signal GOE), and carries out image processing based on the received at least one timing signal.

Note that, when the liquid crystal display device 100 includes the configuration for realizing the image processing illustrated in FIG. 2 and the configuration for realizing the image processing illustrated in FIG. 8 (see FIG. 10), the image processing circuit 40 determines the line to next enhance and correct the grayscale based on the gate output enable signal GOE. Further, the image processing circuit 40 calculates the correction amount of the grayscale (input grayscale) corresponding to the input display data DAT based on the combination of the polarity information of the gate output enable signal GOE and the polarity information of the polarity control signal POL1.

In the respective configuration examples described above, one image processing circuit 40 and one timing controller 50 are provided, but the liquid crystal display device 100 according to this embodiment is not limited thereto. For example, as illustrated in FIG. 11, a plurality of image processing circuits 40 and a plurality of timing controllers 50 may be provided.

Figure 11:
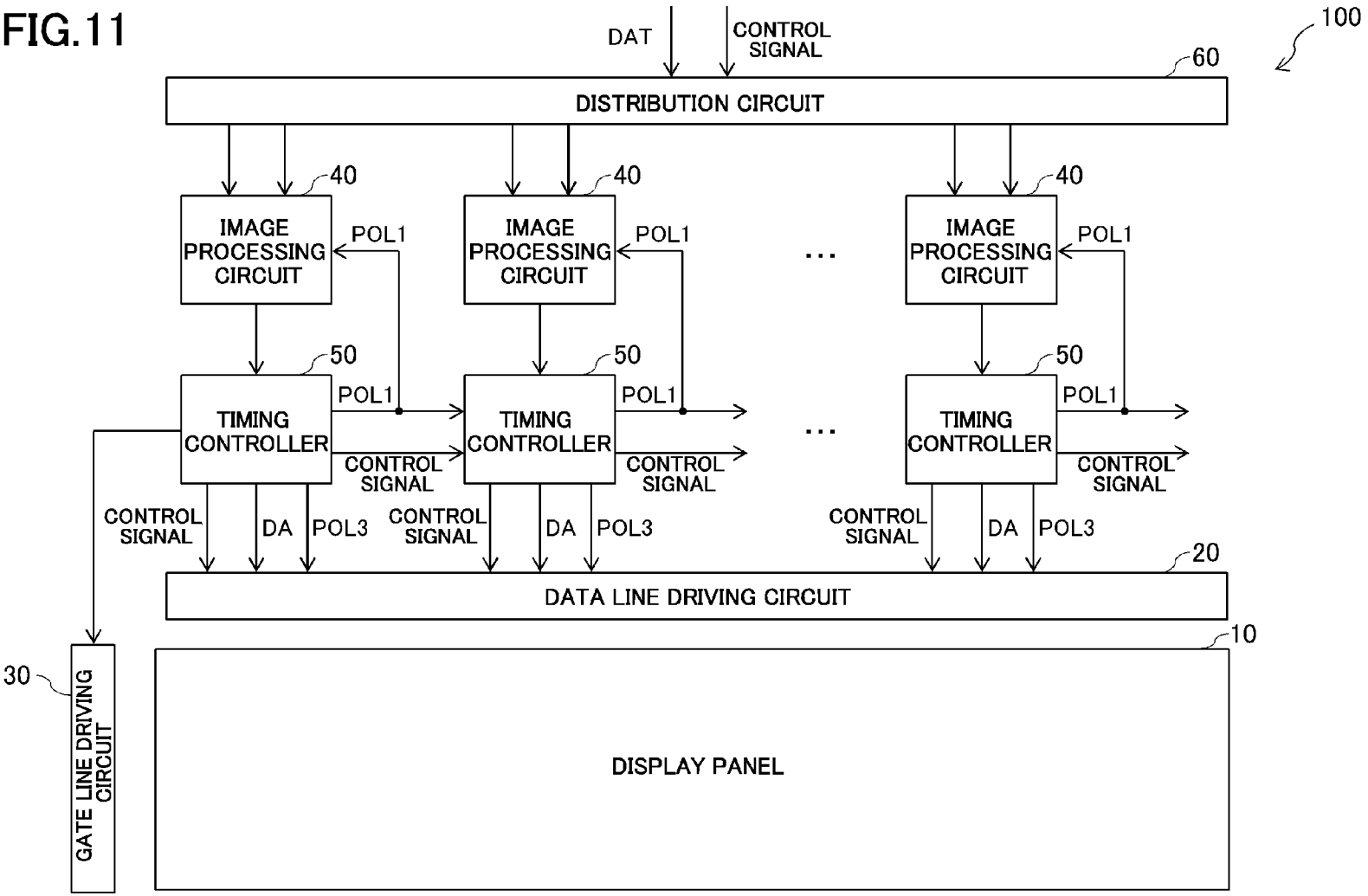
FIG. 11 is a plan view for illustrating another configuration of the liquid crystal display device.

The liquid crystal display device 100 illustrated in FIG. 11 includes a distribution circuit 60, the plurality of image processing circuits 40, and the plurality of timing controllers 50. The distribution circuit 60 receives the input display data DAT and the control signal output from the external display system, to thereby distribute the input display data DAT and transfer the control signal to each of the image processing circuits 40. For example, the distribution circuit 60 converts the input display data DAT having a resolution of 8K4K into the input display data DAT having a resolution of 4K2K, and distributes the converted input display data DAT to each of the image processing circuits 40.

As illustrated in FIG. 11, the plurality of timing controllers 50 are cascade-connected to each other. The image processing circuit 40 receives the input display data DAT and the control signal from the distribution circuit 60, and receives the polarity control signal POL1 generated by the timing controller 50 corresponding to the image processing circuit 40, to thereby carry out the image processing based on those received signals. The plurality of image processing circuits 40 are not directly connected to each other, or do not communicate in synchronization with each other.

Figure 12:
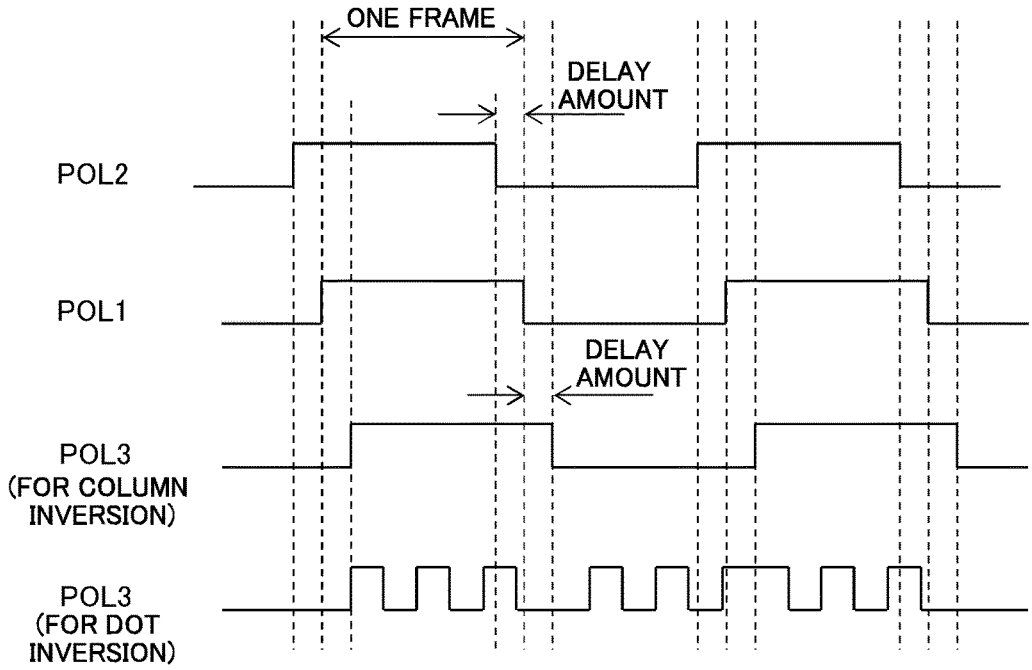
FIG. 12 is a timing chart for illustrating waveforms of polarity control signals POL1, POL2, and POL3.

In the liquid crystal display device 100 illustrated in FIG. 11, a polarity control signal POL3 input from the timing controller 50 to the data line driving circuit 20 is a signal delayed from the polarity control signal POL1 input from the timing controller 50 to the image processing circuit 40. FIG. 12 is a timing chart for illustrating the waveforms of the polarity control signal POL1, the polarity control signal POL2, and the polarity control signal POL3. The polarity control signal POL2 is a signal obtained by adjusting the timing of the polarity control signal POL1 in the image processing circuit 40 (see FIG. 3). Note that, the polarity control signal POL3 of FIG. 12 may be a signal to be used for column inversion drive, or may be a signal to be used for dot inversion drive.

With the above-mentioned configuration, the image processing can be carried out in parallel in the plurality of image processing circuits 40, and hence the product cost can be reduced. Further, mutual communication among the plurality of image processing circuits 40 is unnecessary, and hence the circuit configuration can be simplified.

Note that, the configuration illustrated in FIG. 11 is applicable to the respective configuration examples illustrated in FIG. 2, FIG. 5, FIG. 7, FIG. 8, and FIG. 10.

While there have been described what are at present considered to be certain embodiments of the application, it will be understood that various modifications may be made thereto, and it is intended that the appended claims cover all such modifications as fall within the true spirit and scope of the invention.

What is claimed is:

1. A liquid crystal display device, comprising:

a display panel comprising:

a plurality of gate lines extending in a row direction; and a plurality of data lines extending in a column direction;

a data line driving circuit configured to supply a plurality of data signals to the plurality of data lines;

a gate line driving circuit configured to supply a plurality of gate signals to the plurality of gate lines;

an image processing circuit configured to carry out image processing on input display data input from an outside; and a timing controller configured to receive display data subjected to the image processing by the image processing circuit, to thereby generate a polarity control signal for determining a polarity of the plurality of data signals to be supplied to the plurality of data lines, the image processing circuit being configured to receive the polarity control signal generated by the timing controller, to thereby carry out the image processing on the input display data based on the received polarity control signal and supply the display data to the timing controller.

2. The liquid crystal display device according to claim 1, wherein the image processing circuit and the timing controller are each configured of an individual integrated circuit (IC), wherein the image processing circuit is a field programmable gate array.

3. The liquid crystal display device according to claim 1, wherein the image processing circuit comprises a plurality of image processing circuits, wherein the timing controller comprises a plurality of timing controllers, and wherein each of the plurality of image processing circuits receives the polarity control signal generated in the timing controller corresponding to the each of the plurality of image processing circuits, to thereby carry out the image processing on the input display data based on the received polarity control signal.

4. The liquid crystal display device according to claim 3, wherein the plurality of timing controllers are cascade-connected to each other, and wherein the polarity control signal output from the timing controller is input to the image processing circuit corresponding to the timing controller, and is also input to the adjacent timing controller.

5. The liquid crystal display device according to claim 4, wherein the plurality of image processing circuits are not directly connected to each other.

6. The liquid crystal display device according to claim 1, wherein the image processing circuit corrects an input grayscale corresponding to the input display data to a grayscale that is one of higher and lower than a target grayscale.

7. The liquid crystal display device according to claim 6, wherein the image processing circuit corrects the input display data so that a correction amount for the input display data corresponding to the plurality of data signals with a positive polarity and a correction amount for the input display data corresponding to the plurality of data signals with a negative polarity are different from each other.

8. The liquid crystal display device according to claim 6, wherein the image processing circuit corrects the input display data so that a correction amount for the input display data corresponding to the plurality of data signals with a positive polarity is larger than a correction amount for the input display data corresponding to the plurality of data signals with a negative polarity.

9. The liquid crystal display device according to claim 1, wherein the image processing circuit corrects an input grayscale of each pixel corresponding to the input display data in accordance with a position of a pixel in a display region.

* * * * *